US009758361B2

(12) United States Patent
Zoni et al.

(10) Patent No.: US 9,758,361 B2
(45) Date of Patent: Sep. 12, 2017

(54) MACHINE AND A METHOD FOR FILLING CONTAINERS

(71) Applicant: Sidel S.p.A. CON SOCIO UNICO, Parma (IT)

(72) Inventors: Roberto Zoni, Parma (IT); Annalisa Malfatto, Parma (IT)

(73) Assignee: SIDEL S.P.A. CON SOCIO UNICO, Parma (IT)

( * ) Notice: Subject to any disclaimer, the term of this patent is extended or adjusted under 35 U.S.C. 154(b) by 53 days.

(21) Appl. No.: 14/758,132

(22) PCT Filed: Dec. 13, 2013

(86) PCT No.: PCT/EP2013/076619
§ 371 (c)(1),
(2) Date: Jun. 26, 2015

(87) PCT Pub. No.: WO2014/102075
PCT Pub. Date: Jul. 3, 2014

(65) Prior Publication Data

US 2016/0194189 A1 Jul. 7, 2016

(30) Foreign Application Priority Data

Dec. 28, 2012 (EP) ..... 12199777

(51) Int. Cl.
*B67C 3/24* (2006.01)
*B65C 3/16* (2006.01)
(Continued)

(52) U.S. Cl.
CPC ..... *B67C 3/242* (2013.01); *B65C 3/16* (2013.01); *B65C 3/26* (2013.01); *B65C 9/04* (2013.01);
(Continued)

(58) Field of Classification Search
CPC B67C 3/242; B67C 3/225; B67C 3/06; B67C 3/24; B67C 3/10; B67C 3/2614;
(Continued)

(56) References Cited

U.S. PATENT DOCUMENTS 3,516,455 A * 6/1970 Carter ..... B67C 3/06 141/119
6,283,177 B1 * 9/2001 Naka ..... B65G 47/847 141/144
(Continued)

FOREIGN PATENT DOCUMENTS

CA 2023652 A1 * 2/1991 ..... B65B 45/50
EP 0414031 2/1991
(Continued)

OTHER PUBLICATIONS

International Search Report and Written Opinion mailed Mar. 5, 2014 in corresponding PCT International Application.
(Continued)

*Primary Examiner* — Nicolas A Arnett
(74) *Attorney, Agent, or Firm* — Finnegan, Henderson, Farabow, Garrett & Dunner, LLP

(57) ABSTRACT

A machine for filling a container having a longitudinal axis is disclosed. The machine comprises a conveying device, and at least one handling unit moved by the conveying device along a path. The at least one handling unit comprises a support device configured to receive and retain the container, and at least one filling device configured to feed a pourable product into the container as the at least one handling unit travels along the path. The machine further comprises an actuator configured to rotate the container about the longitudinal axis while the container is filled with the pourable product by the at least one filling device.

20 Claims, 6 Drawing Sheets

(51) Int. Cl.

| | |
|---|---|
| ***B65C 9/04*** | (2006.01) |
| ***B67C 3/10*** | (2006.01) |
| ***B67C 3/26*** | (2006.01) |
| ***B65C 3/26*** | (2006.01) |
| ***B67C 3/06*** | (2006.01) |
| ***B67C 3/22*** | (2006.01) |

(52) U.S. Cl.
CPC ..... *B67C 3/06* (2013.01); *B67C 3/10* (2013.01); *B67C 3/225* (2013.01); *B67C 3/24* (2013.01); *B67C 3/2614* (2013.01); *B67C 2003/2671* (2013.01)

(58) Field of Classification Search
CPC ..... B67C 2003/2671; B65C 3/26; B65C 3/16; B65C 9/04
USPC ..... 141/14–150, 168, 171–172
See application file for complete search history.

(56) References Cited

U.S. PATENT DOCUMENTS 6,286,568 B1 * 9/2001 Araki ..... B65B 43/50 141/10
6,338,371 B1 * 1/2002 Araki ..... B65B 43/50 141/129
7,278,451 B2 * 10/2007 Cavallari ..... B67C 3/242 141/152
8,240,459 B2 * 8/2012 Bernhard ..... B65G 29/00 198/481.1
8,852,370 B2 * 10/2014 Zoni ..... B65C 9/40 156/277
2002/0166640 A1 * 11/2002 Caprara ..... B65C 3/16 156/556
2005/0268988 A1 * 12/2005 Cavallari ..... B67C 3/242 141/177
2013/0056148 A1 * 3/2013 Zoni ..... B65C 9/40 156/280

FOREIGN PATENT DOCUMENTS

| | | |
|---|---|---|
| EP | 1251074 | 10/2002 |
| EP | 2332845 | 6/2011 |
| FR | 2151725 | 4/1973 |
| JP | 2009-029426 | 2/2009 |
| WO | WO 2011/007372 | 1/2011 |

OTHER PUBLICATIONS

European Patent Office Communication pursuant to Article 94(3) EPC dated Apr. 8, 2016, in counterpart European Patent Application No. 12199777.9.

* cited by examiner

MACHINE AND A METHOD FOR FILLING CONTAINERS

CROSS-REFERENCE TO RELATED APPLICATIONS

This application is a National Stage Entry of International Application No. PCT/EP2013/076619, filed Dec. 13, 2013, which claims priority from European Patent Application No. 12199777.9, filed Dec. 28, 2012. The entire contents of the above-referenced applications are expressly incorporated herein by reference.

TECHNICAL FIELD

The present invention relates to a machine and a method for filling containers with pourable products, in particular carbonated liquids, such as sparkling water, soft drinks and beer, which the following description will refer to, although this is in no way intended to limit the scope of protection as defined by the accompanying claims.

The present invention may be also used to particular advantage for any type of container, such as containers or bottles made of glass, plastics, aluminum, steel and composites, and for any type of pourable product, such as non-carbonated liquids (including still water, juices, teas, sport drinks, liquid cleaners, wine, etc), emulsions, suspensions and high viscosity liquids.

BACKGROUND ART

As is known, many pourable products are sold in a wide range of bottles or containers, which are sterilized, filled and closed in container handling plants typically including a plurality of processing stations or machines, such as rinsing machines, filling machines, capping machines and labelling machines.

These processing stations can be defined by linear machines or, more frequently, by carousel-type machines. The following description will refer to carousel-type machines only, although this is in no way intended to limit the scope of protection of the present application.

The containers to be handled are generally fed to and removed from these machines by means of a transport system including star wheels and linear conveyors.

Known container handling plants are therefore fairly bulky and allow little freedom of choice in terms of layout; moreover, this kind of plants requires quite complicated adjustments to synchronize the different processing stations and entails relatively high operating and maintenance costs.

Another problem posed in respect of known filling machines is the formation of foam at the end of the operation of filling the container.

This problem is mainly caused by the fact that, for reasons of economy, commercial containers are not such larger than the volume required for accommodating of the contents. Thus, during filling operations, which have to be carried out at high speed, it is common for some amount of liquid in the form of foam to bubble over the top of the container prior to the container being capped or sealed. The product loss can be as high as ten percent, which translates into higher cost for the consumer or lower profitability for the bottler, or both.

To reduce this product loss, some filling machines include a dwell station that allows for the product foam in a recently filled container to settle prior to capping.

Other filling machines include a short suction pipe adapted to be introduced into the container to be sealed, and a suction system whereby the foam over the top surface of the liquid is removed and optionally recycled into the product reservoir.

Some filling machines may also use blast nozzles for blowing any drops and residual foam from the surfaces to be sealed or capped.

Some filling machines reduce the temperature of the liquid at the mixing tanks or other reservoirs to reduce foaming.

In certain cases, the containers are purposefully overfilled to compensate for lost product in the form of foam and thereby achieve the desired net fill volume, which results in undesirable product loss.

Other possible solutions are based on the use of ultrasonic waves for collapsing the foam; in practice, the portion of liquid forming the foam again becomes part of the liquid content of the container rather than being wasted.

DISCLOSURE OF INVENTION

It is an object of the present invention to provide a machine for filling containers, designed to eliminate at least one of the aforementioned drawbacks, and which is cheap and easy to implement.

According to one aspect of the present invention, there is provided a machine for filling containers as claimed in claim 1.

The present invention also relates to a method for filling containers as claimed in claim 15.

According to another aspect of the present invention, there is provided a machine for filling containers as claimed in claim 23.

The present invention also relates to a method for filling containers as claimed in claim 30.

BRIEF DESCRIPTION OF THE DRAWINGS

A non-limiting embodiment of the present invention will be described by way of example with reference to the accompanying drawings, in which.

BEST MODE FOR CARRYING OUT THE INVENTION

Figure 1:
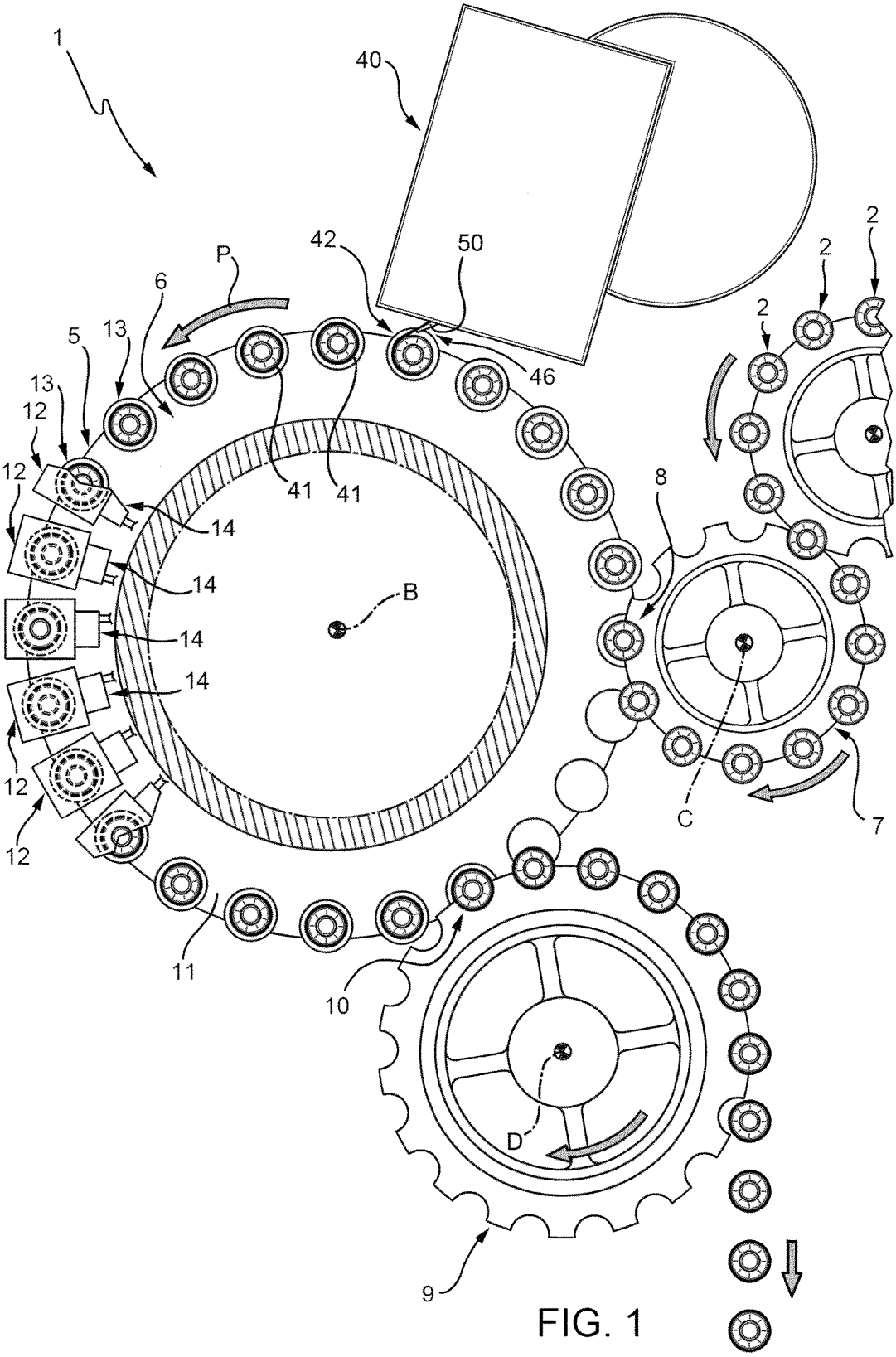
FIG. 1 shows a schematic top plan view, with parts removed for clarity, of a first embodiment of a machine for filling containers according to the present invention.

Number 1 in FIG. 1 indicates as a whole a machine for filling containers, in particular bottles 2, with pourable products, in the example shown carbonated liquids, such as sparkling water or carbonated beverages, including soft drinks and beer.

Figure 3:
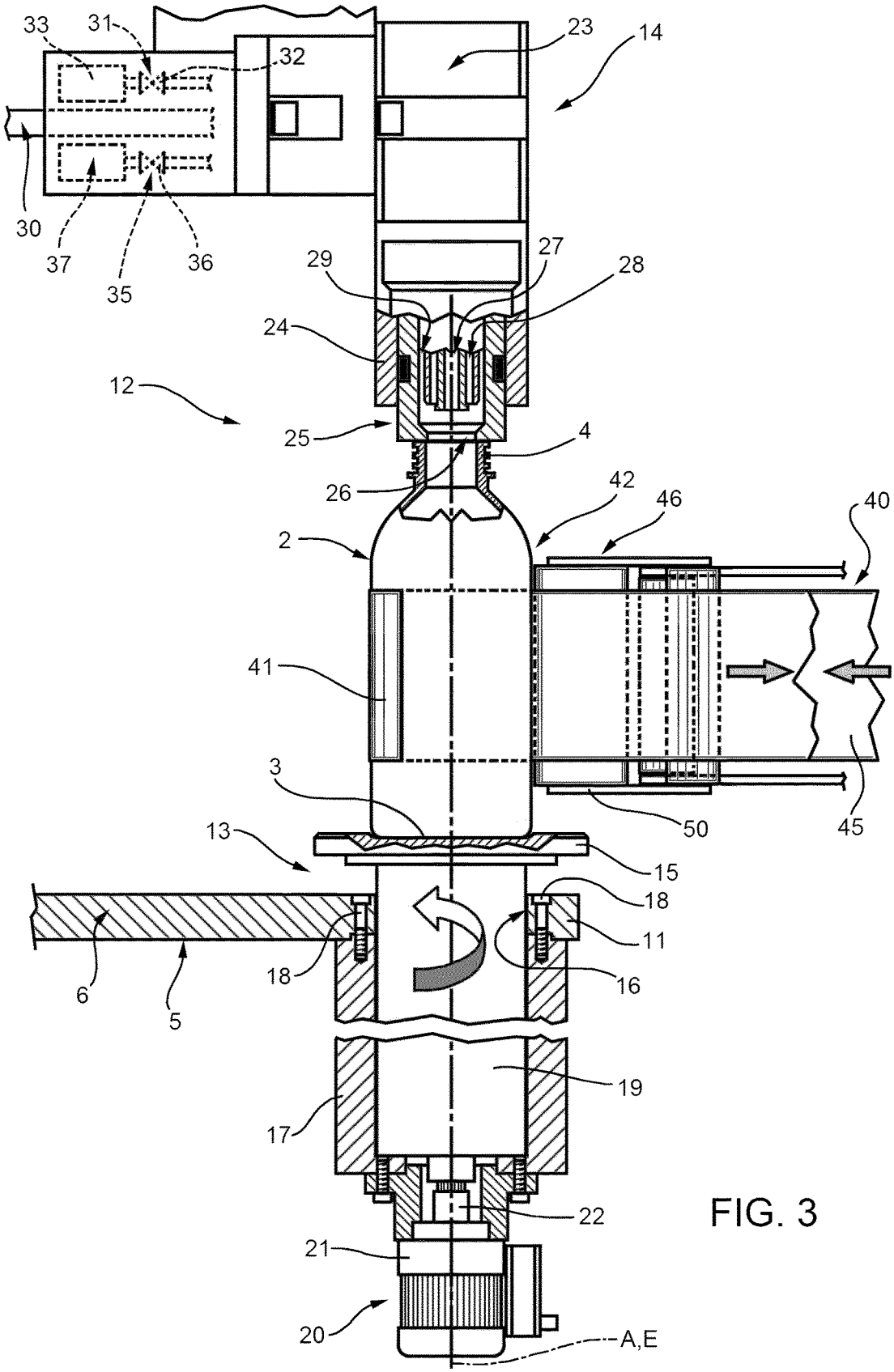
FIG. 3 shows a larger-scale, partly sectioned side view of a handling assembly of the FIG. 1 machine for carrying and filling a relative container.

As visible in FIG. 3, each bottle 2 has a longitudinal axis A and is bounded at the bottom by a bottom wall 3 substantially perpendicular to axis A, and has a top neck 4 substantially coaxial with the axis A.

In the example shown, the bottles 2 filled by machine 1 are made of plastics; however, machine 1 may be also used for other types of containers, such as containers made of aluminum, steel, glass and composites. Moreover, the containers used in machine 1 may be filled with any type of pourable product, including non-carbonated liquids (such as still water, juices, teas, sport drinks, liquid cleaners, wine, etc), emulsions, suspensions and high viscosity liquids.

Machine 1 comprises a conveying device 5 that, according to the present invention, serves not only to fill the bottles 2 but also to label them during the filling process.

In the preferred embodiment as illustrated on the figures, the conveying device 5 comprises a carousel 6, which is mounted to rotate continuously (anticlockwise in FIGS. 1 and 2) about a vertical axis B perpendicular to the FIG. 1 plane. The carousel 6 receives a succession of empty bottles 2 from an input star wheel 7, which is connected to carousel 6 at a first transfer station 8 and is mounted to rotate continuously about a respective longitudinal axis C parallel to axis B. The carousel 6 releases a succession of filled bottles 2 to an output star wheel 9, which is connected to carousel 6 at a second transfer station 10 and is mounted to rotate continuously about a respective longitudinal axis D parallel to axes B and C.

Machine 1 further comprises a plurality of handling units 12, which are equally spaced angularly about axis B, are mounted along a peripheral portion 11 of carousel 6, and are moved by the carousel 6 along a path P extending about axis B and through stations 8 and 10.

As shown in the enclosed Figures, each handling unit 12 comprises a support device 13 adapted to receive and retain a relative bottle 2 in a vertical position, in which such bottle 2 has its axis A parallel to the axis B of carousel 6, and a filling device 14 for feeding the pourable product into a bottle 2 as the support device 13 travels along path P.

Each filling device 14 is conveniently arranged above the bottle 2 to be filled.

With particular reference to FIG. 3, support device 13 of each handling unit 12 comprises a support plate 15 adapted to receive a relative bottle 2 in a vertical position, i.e. resting on support plate 15 with its axis A extending vertically; more specifically, the bottle 2 is arranged with its bottom wall 3 in contact with the support plate 15 and extends vertically from the latter.

Support plate 15 is advantageously mounted on carousel 6 in a rotatable manner about its own axis E, coaxial in use with axis A of the relative bottle 2. In greater detail, peripheral portion 11 of carousel 6 has a plurality of through holes 16 equally spaced angularly about axis B, and a plurality of support sleeves 17, each protruding downwards from the edge of a relative hole 16; in the example shown, each support sleeve 17 is secured to the bottom face of the edge of the relative hole 16 by screws 18 and extends coaxially with a relative axis E.

Each support plate 15 is secured on top of a relative rotating element 19 engaging both the relative hole 16 and support sleeve 17 in a rotatable manner about relative axis E.

Each support device 13 further comprises an electric motor 20 having a casing 21, coaxially secured to a bottom end of the relative support sleeve 17, and an output shaft 22 supported in a rotatable manner by the casing 21 and coupled to a bottom end of the relative rotating element 19.

In practice, electric motor 20 and rotating element 19 of each handling unit 12 define actuator means for rotating a bottle 2 about its axis A during its movement along path P together with carousel 6.

Thanks to this type of arrangement, each bottle 2 has, in use, a revolution motion about axis B together with carousel 6 and a rotary motion about its own axis A as a result of the torque imparted by electric motor 20 to rotating element 19 and support plate 15.

Filling device 14 of each handling unit 12 basically comprises a support block 23 secured, in a manner known per se and not shown, to the carousel 6 and terminating, towards the bottle 2, with a hollow body 24, in the example shown having a tubular configuration; filling device 14 of each handling unit 12 further comprises a filling head 25 engaging hollow body 24 in a fluid-tight manner and adapted to cooperate with the top neck 4 of the relative bottle 2 to perform the filling operation.

In particular, each filling head 25 defines a filling mouth 26 and has a lower end 25*a* facing the top neck 4 of the relative bottle 2 and provided with a gasket (known per se and not shown).

Each filling head 25 is supported by the relative support block 23 in a rotatable manner about the relative axis E; each filling head 25 is also supported by the relative support block 23 in a displaceable manner along the relative axis E between a rest position (not shown), in which it has its lower end 25*a* spaced from the top neck 4 of the relative bottle 2, and a filling position (FIG. 3), in which it has the gasket of its lower end 25*a* in contact with the top neck 4 of the relative bottle 2 so that the relative filling mouth communicates with the inside of the bottle 2 in a fluid-tight manner towards the outside.

In practice, each filling head 25 is supported by the relative support block 23 in an idle manner about axis E and can be displaced along the same axis between the rest position and the filling position; in this way, when a filling head 25 is set in the filling position, rotation of the relative support plate 15 about its axis E is transmitted, through the relative bottle 2, to the filling head 25, which is also driven to rotate about the axis E, so performing a guiding and supporting action on top neck 4 of the bottle 2.

Each filling head 25 defines a central conduit 27, a first annular conduit 28 extending around the conduit 27, and a second annular conduit 29 formed between the side wall of the filling head 25 and the outer side wall of the conduit 28.

Support block 23 of each filling device 14 internally defines at least three different fluid circuits, known per se and only schematically shown in FIG. 3:

- a product circuit 30 for connecting, through an ON/OFF valve (known per se and not shown), the relative annular conduit 28 to a tank (known per se and not shown) containing the pourable product;
- a pressurization circuit 31 for connecting, through an ON/OFF valve 32, the relative central conduit 27 to a chamber 33 filled with a pressurization fluid, e.g. carbon dioxide; and
- a decompression circuit 35 for connecting, through an ON/OFF valve 36, the relative annular conduit 29 to a chamber 37 in turn connected to a discharge device (known per se and not shown).

According to one important aspect of the present invention, each bottle 2 is in use rotated about its axis A, by activating the relative electric motor 20, while the bottle 2 is filled with the pourable product by the relative filling device 14.

Thanks to this additional rotation of the bottle 2 about its axis A during the revolution movement of the same bottle 2 about axis B, it is possible to obtain the following effects:

- the centrifugal force caused by this double rotation generates an additional pressure on the pourable product in the bottle 2, which entraps the carbon dioxide into the product; and
- the pourable product comes down into the bottle 2 along the lateral wall thereof instead of centrally.

Both these effects permits to obtain a significant reduction in the formation of foam at the end of the filling operation.

According to a possible alternative not shown, each support device 13 may be defined by gripping means acting on the top neck 4 of a bottle 2 to retain it in a suspended position. In this case, the rotary motion of each bottle 2 about its axis A may be obtained by an electric motor having a casing, secured to the support block 23 of the relative filling device 14, and an output shaft connected to the relative filling head 25 and to the gripping means. In practice, in this case, the electric motor would be carried by the relative filling device 14.

According to another important aspect of the present invention, machine 1 further comprises a labelling unit 40 arranged peripherally with respect to carousel 6 and configured to feed a succession of labels 41 to the respective handling units 12 while such units are advanced along path P by carousel 6 and pass by the labelling unit 40.

As visible in FIG. 1, labelling unit 40 is arranged between input star wheel 7 and output star wheel 9 along path P; more specifically, labels 41 are supplied to handling units 12 at a transfer station 42 interposed between transfer stations 8 and 10 along path P and preferably arranged closer to transfer station 8 than transfer station 10.

Figure 2:
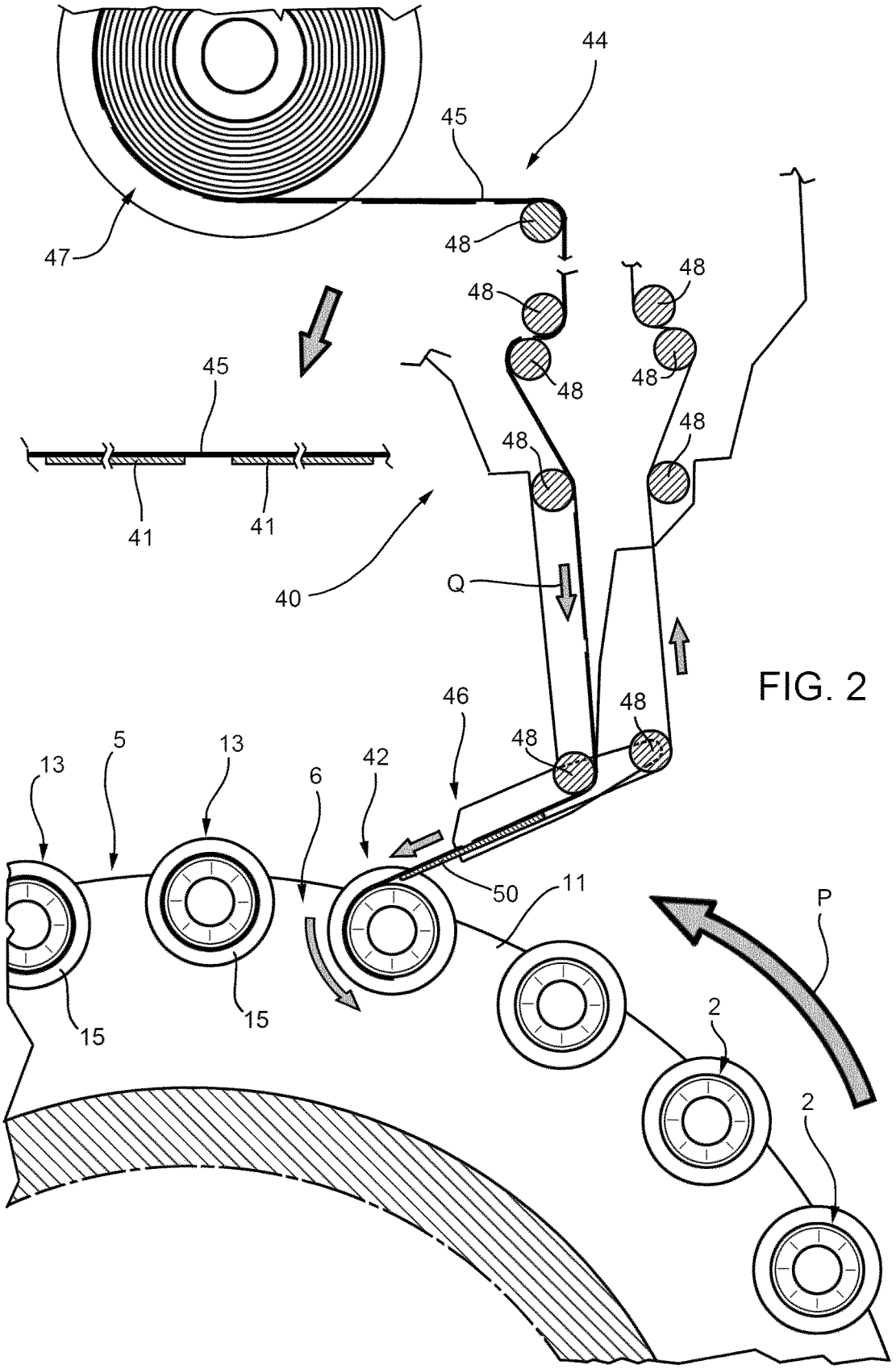
FIG. 2 shows a larger-scale top plan view, with parts removed for clarity, of a part of the FIG. 1 machine.

With particular reference to FIG. 2, labelling unit 40 basically comprises a supply assembly 44 for supplying a web 45, provided with the labels 41, along a path Q towards carousel 6, and an interaction device 46 interacting with the web 45 at transfer station 42 to separate each label 41 from the rest of the web 45 and supplying such label 41 to the handling unit 12 passing by the transfer station 42.

In the example shown, labels 41 are of the pressure-sensitive type and are originally affixed to web 45 at spaced apart positions.

Supply assembly 44 basically comprises a supply reel 47, off which web 45 is unwound, and a plurality of rollers 48, about which the web 45 is wound to be guided and supplied along path Q; at least one of the rollers 48 is motorized to drive web 45 off the supply reel 47 and towards transfer station 42 of carousel 6.

In the embodiment shown in FIGS. 2 and 3, interaction device 46 comprises a peeler blade 50, over which the web 45 is pulled, thereby causing each label 41 to separate from the web 45, which is then disposed of. In practice, at transfer station 42, labels 41 are sequentially peeled off web 45 about peeler blade 50 and applied to corresponding bottles 2 sequentially arriving at transfer station 42 as a result of the advancement of handling units 12 by carousel 6.

According to a possible alternative not shown, labels 41 may be integral parts of a web, which is then cut by cutting means at the transfer station 42 to feed a succession of labels 41 to the bottles 2 on carousel 6.

In order to allow application of each label 41 on the corresponding bottle 2, the latter is rotated about its axis A by activating electric motor 20.

As it will be explained in greater detail hereafter, the application of each label 41 on the corresponding bottle 2 is performed after pressurization of such bottle 2 by opening valve 32 of the relative pressurization circuit 31.

Operation of machine 1 will now be described with reference to the filling of one bottle 2, and therefore to one handling unit 12, and as of the instant in which such bottle 2 is received by support device 13 of the handling unit 12 from input star wheel 7 in order to be filled with the pourable product.

In this condition, the bottle 2 is centered with respect to the relative filling device 14 by moving the filling head 25 from the rest position to the filling position. In particular, the gasket of the lower end 25*a* of the filling head 25 contacts the top neck 4 of the bottle 2, which reaches a position coaxial with the filling head 25. In practice, the axis A of the bottle 2 is coaxial with the axis E of the filling head 25.

At this point, valve 32 of pressurization circuit 31 is opened (the valve of product circuit 30 and valve of decompression circuit 35 are in a closed condition) and is maintained in that condition up to the moment in which pressure in the bottle 2 reaches a given first value V1, for instance about 1.5 bar, adapted to make the bottle 2 sufficiently rigid for labelling. Then, the valve 32 is closed.

In the meantime, the handling unit 12 reaches transfer station 42, where a label 41 is supplied by labelling unit 40 to the bottle 2; in order to allow application of the label 41 on the bottle 2, the latter is rotated about its axis A by activating electric motor 20. In particular, in this stage, rotary motion imparted by output shaft 22 of electric motor 20 to rotating element 19 and support plate 15 is transmitted to the bottle 2 and from the latter to the filling head 25, which is in contact with the top neck 4 of the bottle 2 and is supported in an idle condition by support block 23.

Once the label 41 has been applied on bottle 2, a further pressurization step is carried out by opening valve 32 of pressurization circuit 31, which is maintained in the open condition up to the moment in which pressure in the bottle 2 reaches a given second value V2, for instance about 6 bar, higher than first value V1 and defining the requested condition for the filling operation with the carbonated liquid. Then, the valve 32 is again closed.

By opening the valve of product circuit 23, the actual filling of the bottle 2 with the product can be started. This step ends when the product reaches the desired level in the bottle 2.

During this step, electric motor 20 is again activated to rotate the bottle 2 about its axis A. Therefore, the bottle 2 is subjected to a revolution motion about axis B and a rotary motion about axis A. Thanks to this double rotation about axes A and B, the bottle 2 can be filled at high speed with a reduced formation of foam. As a matter of fact, the centrifugal force caused by this additional rotation about axis A generates an additional pressure on the product in the bottle 2, which entraps the carbon dioxide into the product. Moreover, the product comes down into the bottle 2 along the lateral wall thereof instead of centrally.

The next step is the decompression of the bottle 2, which is achieved by connecting the bottle 2 with decompression circuit 35. At this point, the filling head 25 can be moved to the rest position.

In the case in which the pourable product delivered to the bottle 2 is a non-carbonated liquid, the second pressurization step is not performed.

The advantages of machine 1 and the filling method according to the present invention will be clear from the foregoing description.

In particular, the filling process and the labelling process of the containers are both performed on the same machine. This solution, when compared to a traditional solution using distinct machines for performing such processes, permits to reduce:

- the overall space occupied by the resulting container handling plant;
- the maintenance cost; and
- the operating cost, as only one carousel with a relative motor is used instead of two.

Moreover, the step of pressurizing the containers, normally used in a filling process, is exploited in the labelling process of containers made of a deformable material, such as plastics, for permitting the application of the label directly on the container.

Last but not least, the rotation of each container about its axis, normally used in a labelling process to permit application of the label on the container, is also used in the filling operation to reduce the formation of foam and thereof to increase the filling speed. In fact, as above explained, the additional rotation of each container about its axis, during the revolution movement of the same container about the carousel axis, permits to obtain the following effects:

- the centrifugal force caused by this additional rotation generates an additional pressure on the pourable product in the container, which, in the case of carbonated liquids, entraps the carbon dioxide into the product; and
- the pourable product comes down into the container along the lateral wall thereof instead of centrally.

Figure 4:
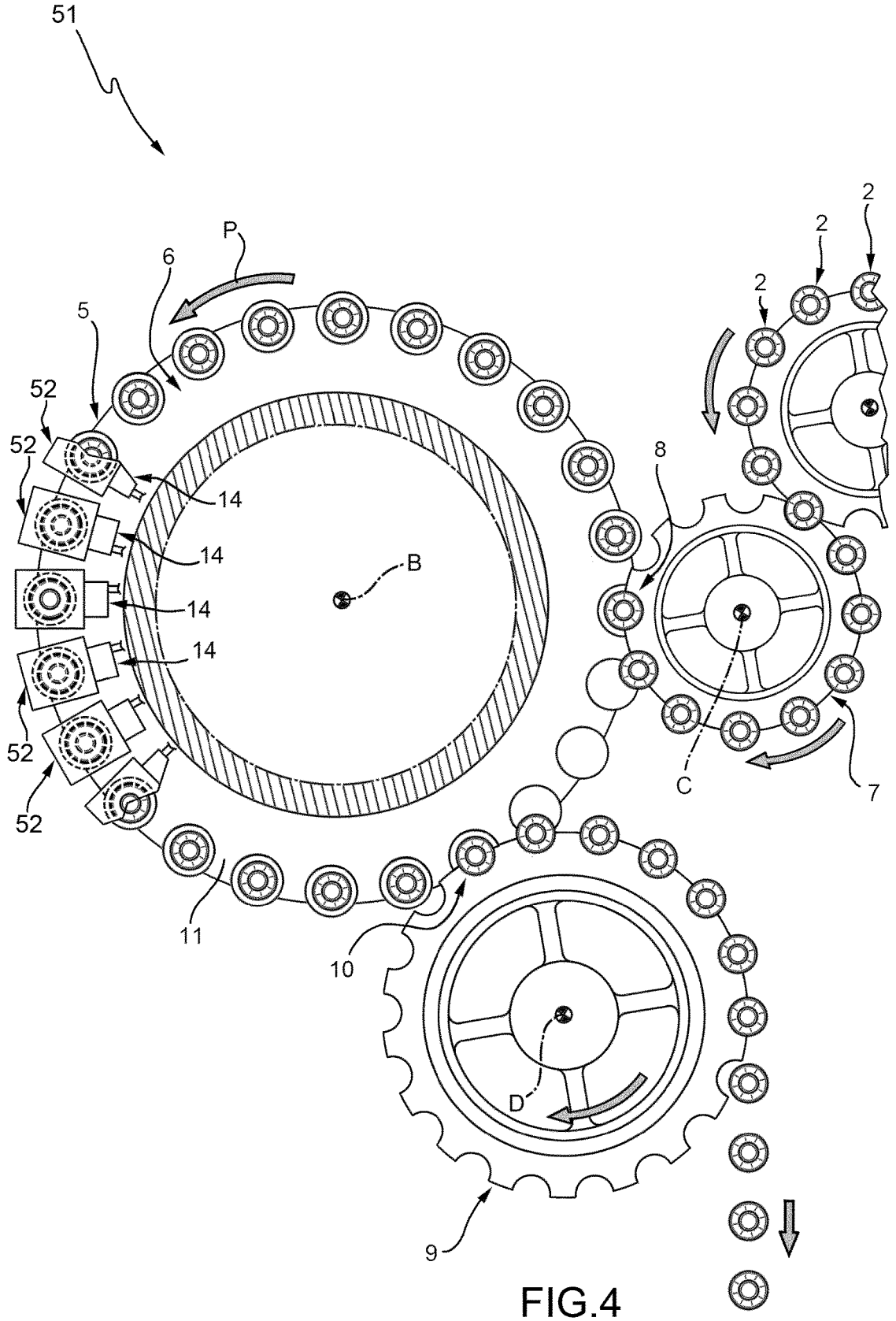
FIG. 4 shows a schematic top plan view, with parts removed for clarity, of a second embodiment of a machine for filling containers according to the present invention.

FIG. 4 shows a machine 51 for filling bottles 2, which differs from the machine shown in FIGS. 1-3 in that the labeling unit 40 is eliminated and the handling units 12 are eliminated and replaced by respective handling units 52.

Figure 5:
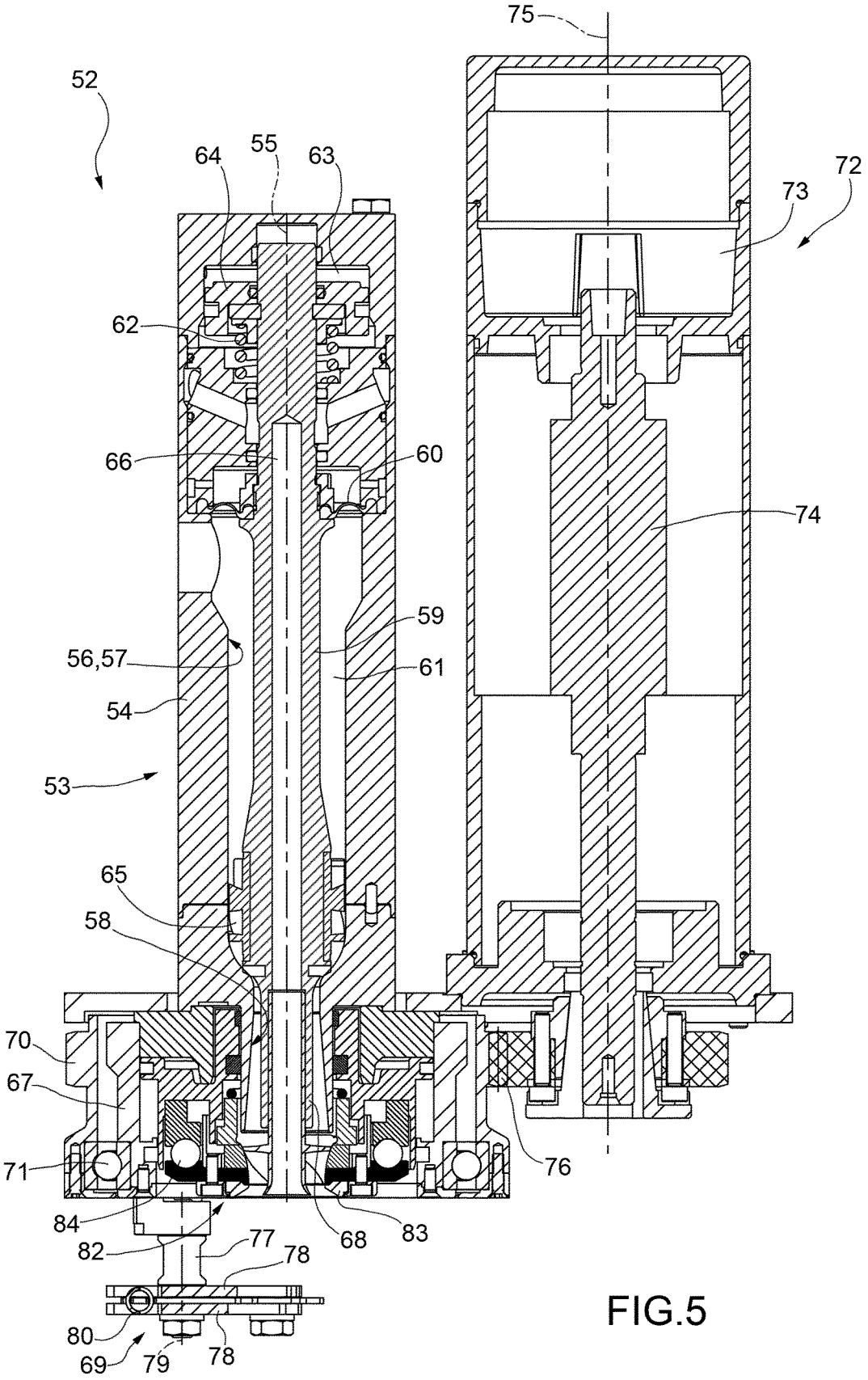
FIG. 5 shows a sectioned side view, with parts removed for clarity, of a handling assembly of the FIG. 4 machine for carrying and filling a relative container.
Figure 6:
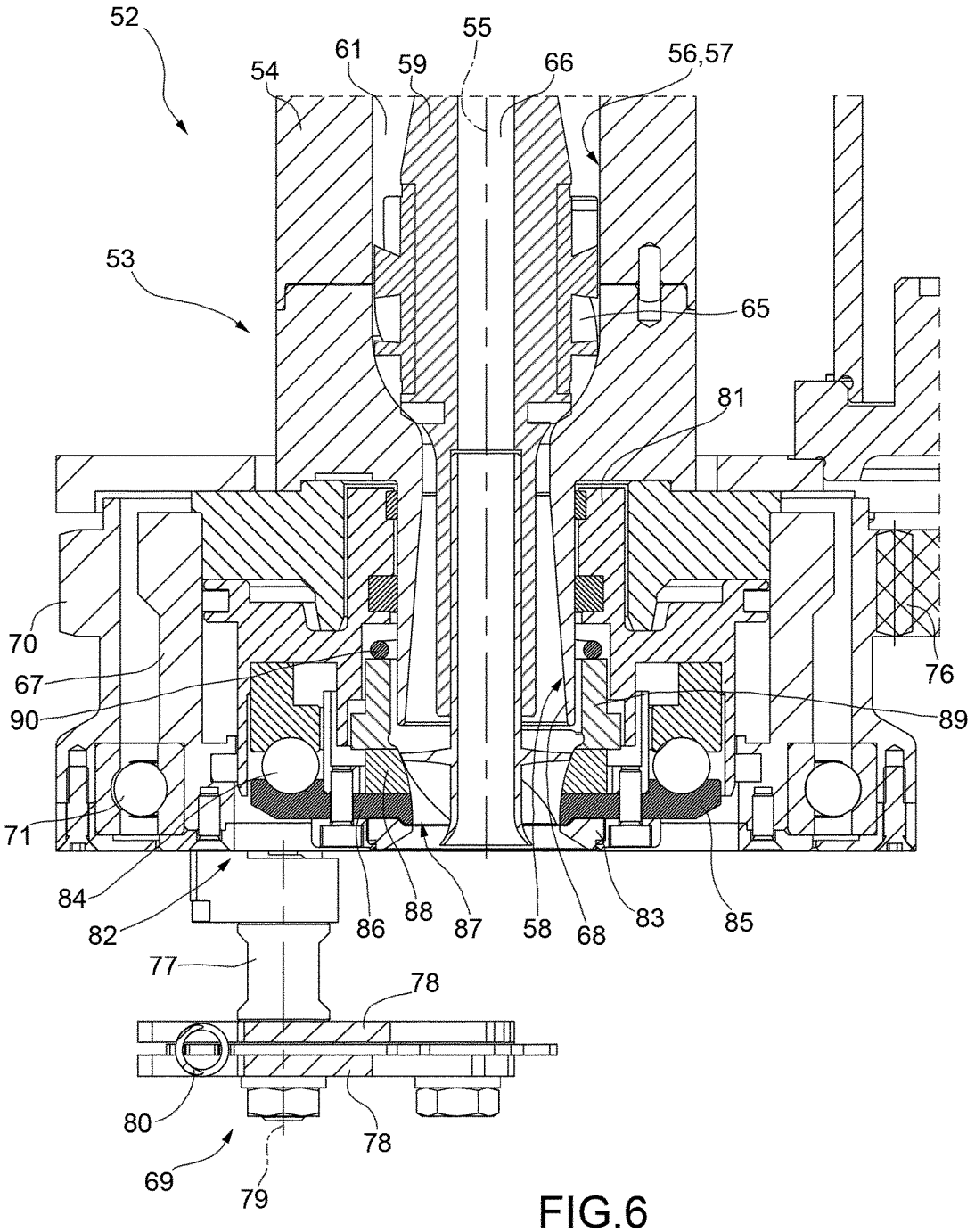
FIG. 6 shows a larger-scale sectioned side view, with parts removed for clarity, of a detail of the handling assembly of FIG. 5.

As shown in FIGS. 5 and 6, each handling unit 52 comprises a filling device 53 comprising, in turn, a vertical post 54 with a cylindrical shape, which has a longitudinal axis 55 parallel to axis B, and is fixed to the peripheral portion 11 of the carousel 6.

The post 54 is radially delimited by an inner wall 56 comprising an upper wide portion 57 and a lower narrow portion 58, and is engaged in a sliding manner by a shutter 59 with a tubular shape, which is mounted inside the post 54 coaxial to the axis 55.

The shutter 59 projects downwards from a lower end of the post 54, and is coupled to the post 54 by means of a deformable annular membrane 60, which is interposed between the post 54 and the shutter 59 itself.

The shutter 59 defines, together with the post 54, a tubular feeding duct 61, which extends between the post 54 and the shutter 59, and is connected to a tank (not shown) of the pourable product to be fed into the bottles 2.

The shutter 59 is axially mobile between a lowered closing position, in which the shutter 59 is arranged in contact with the wall 56 so as to be coupled to the post 54 in a fluid-tight manner and close the duct 61, and a raised opening position, in which the duct 61 itself is open.

The shutter 59 is moved to its raised opening position—and normally kept there—by a spring 62, which is mounted between the post 54 and the shutter 59 coaxial to the axis 55, and is moved to its lowered closing position, against the action of the spring 62, by an actuating cylinder 63.

The cylinder 63 is obtained in the post 54 coaxial to the axis 55, is provided with a piston 64, which is coupled to the shutter 59 in an axially and angularly fixed manner, and is connected to a known pneumatic device, which is not shown.

The shutter 59 has, furthermore, a swirler 65, which is obtained on the outer surface of the shutter 59 itself, and extends along—and around—the axis 55, so as to cause the pourable product fed along the duct 61 to have a swirling movement.

The shutter 59 defines an inner feeding duct 66, which extends inside the shutter 59, and is connected to a feeding device (not shown), which is adapted to feed a gas under pressure along the duct 66 and into the bottles 2.

The device 53 comprises, furthermore, an actuating cylinder 67 with a tubular shape, which extends around a lower narrow end 68 of the post 54, is mounted coaxial to the axis 55, and is coupled to the post 54 itself in an angularly and axially fixed manner.

The device 53 cooperates with a gripping member 69 for a bottle 2 comprising a substantially cylindrical bell 70, which is coaxial to the axis 55, extends around the cylinder 67, and is arranged with its concavity facing upwards.

The bell 70 is coupled to the cylinder 67 in an axially fixed manner and, furthermore, is coupled to the cylinder 67 in a rotary manner by interposing a rolling bearing 71, so as to rotate, relative to the cylinder 67 itself and under the thrust of an actuating device 72, around the axis 55.

The device 72 comprises an electric motor 73, which is fixed to the post 54, and is provided with an output shaft 74 having a longitudinal axis 75 that is parallel to the axis 55.

The shaft 74 is coupled to the bell 70 by means of a pair of gears 76, of which one is splined to the shaft 74 and the other is obtained on the outer surface of the bell 70 itself.

The gripping member 69 comprises, furthermore, a support plate 77, which projects downwards from the bell 70, is fixed to the bell 70, and supports a pair of holding jaws 78, which are configured to hold a relative bottle 2 in correspondence to its top neck 4.

The jaws 78 are mounted under the plate 77 and are hinged to the plate 77 so as to rotate, relative to the plate 77 itself, around respective fulcrum axes 79, which are parallel to one another and to the axis 55.

The jaws 78 are moved to a clamping position—and normally kept there—by a spring 80, which is interposed between the jaws 78, and are moved to a release position by the thrust exerted on the jaws 78 themselves by the relative bottle 2 during its insertion into the gripping member 69 or its extraction from the gripping member 69.

The cylinder 67 is provided with a pneumatically operated piston 81, which is mounted so as to slide inside the cylinder 67, extends around the lower end 68, and defines part of a filling head 82.

The head 82 axially projects downwards from the post 54 and comprises, furthermore, a gasket 83 made of an elastomer material, which has an annular shape coaxial to the axis 55, faces, in use, the top neck 4 of the bottle 2, and is coupled to the piston 81 in an axially fixed manner, so as to be moved by the piston 81 between a lowered operating position, in which the gasket 83 is coupled to the top neck 4 in a fluid-tight manner, and a raised rest position, in which the gasket 83 is arranged at a given distance from the upper neck 4 itself.

The gasket 83, furthermore, is coupled to the piston 81 in a rotary manner by interposing a rolling bearing 84, so as to rotate, relative to the piston 81 itself, around the axis 55 under the thrust of the bottle 2.

To this regard, it should be pointed out that the gasket 83 is angularly integral to a lower rotary race of the bearing 84 and that the race 85 radially extends above the gasket 83 so as to define a rotary ring 86 of a mechanical sliding gasket 87.

The gasket 87 allows the piston 81 and the gasket 83, namely the angularly fixed part and the rotary part of the head 82, to be coupled to one another in a fluid-tight manner and comprises, furthermore, a further ring 88, which is mounted above the ring 86 coaxial to the axis 55.

The ring 88 is fixed to the lower free end of a sleeve 89, which is coupled in an angularly fixed and axially sliding manner to the piston 81, and is kept in contact with the ring 86 by a spring 90, which is interposed between the piston 81 and the sleeve 89 itself.

In correspondence to the transfer stations 8, 10, the position of each gripping member 69 and, hence, of the relative jaws 78 around the relative axis 55 is selectively controlled so as to guarantee a correct pick-up and a correct release of the bottles 2, respectively.

The angular position of each gripping member 69 can be selectively controlled by means of an encoder, which is associated with the relative electric motor 73, or by means of a cam mechanism, which cooperates with the bell 70.

According to an embodiment not shown, the gripping members 69 are removed and replaced by respective lower plates, which are arranged under the relative bottles 2 and are motor-operated so as to rotate around the relative axes 55, and the rotation motion is transmitted to the filling heads 82 by means of the bottles 2 themselves. In this case, when the bottles 2 are made of PET, the bottles 2 are pressurized through the feeding duct 66 so as to have a sufficient stiffness, preferably before being caused to rotate around the relative axes 55.

Obviously, the machine 51 has all the advantages deriving from the rotation of the bottles 2 during their filling, as already described for the machine 1.

The invention claimed is:

1. A machine for filling a container having a longitudinal axis, the machine comprising:

a conveying device;

at least one handling unit configured to be moved by the conveying device along a path, the at least one handling unit comprising:

a support device configured to receive and retain the container, and at least one filling device configured to feed a pourable product into the container as the at least one handling unit travels along the path; and an actuator configured to rotate the container about the longitudinal axis while the container is filled with the pourable product by the at least one filling device, wherein:

the at least one filling device comprises a filling head for pouring the pourable product into the container, and the at least one filling device comprises a hollow supporting element secured to the conveying device, and wherein the filling head engages the hollow supporting element in a rotatable manner about a rotation axis coaxial with the longitudinal axis of the container.

2. The machine according to claim 1, wherein the conveying device comprises a conveyor carousel mounted to rotate about an axis to define the path.

3. The machine according to claim 1, wherein the actuator comprises a motor carried by the conveying device and having an output shaft coupled to the support device so as to cause the rotation of the container about the longitudinal axis.

4. The machine according to claim 1, wherein the filling head engages the hollow supporting element in an axially displaceable manner between a first position, in which the filling head contacts a top of the container, and a second position, in which the filling head is spaced apart from the top of the container.

5. The machine according to claim 1, wherein the filling head comprises a slide engaging the hollow supporting element in an axially displaceable manner, a sleeve engaging the slide in a rotatable manner, and a mechanical seal configured to couple the slide and the sleeve to each other in a fluid tight-manner.

6. The machine according to claim 5, wherein the mechanical seal comprises a first ring coupled in an angularly fixed manner to the slide and a second ring coupled in an angularly fixed manner to the sleeve.

7. The machine according to claim 6, wherein the first ring is further coupled in an axially displaceable manner to the slide; the filling head further comprising a spring arranged between the slide and the first ring to move, and normally maintain, the first ring into contact with the second ring.

8. The machine according to claim 6, wherein the filling head further comprises at least one bearing, which is arranged between the slide and the sleeve, and comprises a bearing race, which is coupled in an angularly fixed manner to the sleeve, and is integrally formed with the second ring.

9. The machine according to claim 1, wherein the support device comprises a lower support plate mounted below the container to rotate about a rotation axis coaxial with the longitudinal axis of the container.

10. The machine according to claim 9, wherein the at least one filling device further comprises a pneumatic circuit configured to feed gas under pressure into the container before rotating the lower support plate about the rotation axis.

11. The machine according to claim 1, wherein the support device comprises a gripping member configured to act upon a top neck of the container to retain the container in a suspended position.

12. The machine according to claim 11, wherein the gripping member is coupled in an angularly fixed manner to the filling head to rotate about the rotation axis coaxial with the longitudinal axis of the container.

13. The machine according to claim 1, and further comprising a control device configured to selectively control the angular position of the support device about the longitudinal axis at least at a pick-up station of the container in the at least one handling unit and at a release station of the container from the at least one handling unit.

14. The machine according to claim 1, wherein the at least one filling device further comprises a swirler to impart a swirling movement to the pourable product fed through the filling device.

15. A method for filling a container having a longitudinal axis, the method comprising:

moving at least one handling unit along a path;

feeding the container to the at least one handling unit to be retained and advanced along the path; and filling the container with a pourable product by activating a filling device of the at least one handling unit;

wherein:

the filling is performed while the at least one handling unit is advanced along the path, the container is rotated about the longitudinal axis during the filling, the filling of the container is performed by at least one filling device comprising a filling head for pouring the pourable product into the container, the at least one filling device comprises a hollow supporting element secured to a conveying device, and the filling head engages the hollow supporting element in a rotatable manner about a rotation axis coaxial with the longitudinal axis of the container.

16. The method according to claim 15, wherein the rotation of the container about the longitudinal axis is performed by rotating at least a part of the at least one handling unit about a rotation axis coaxial with the longitudinal axis.

17. The method according to claim 16, further comprising selectively controlling an angular position of the part of the at least one handling unit about the rotation axis at least at a pick-up station of the container in the at least one handling unit and at a release station of the container from the at least one handling unit.

18. The method according to claim 15, wherein the path has a circular configuration about an axis parallel to the longitudinal axis of the container.

19. The method according to claim 15, wherein the container is rotated about the longitudinal axis by a lower support plate mounted below the container to rotate about a rotation axis coaxial with the longitudinal axis, and is filled by a filling head mounted to rotate about the rotation axis under the thrust of the container; and the method further comprises pressurizing the container before rotating the lower support plate about the rotation axis.

20. The method according to claim 15, wherein the container is rotated about the longitudinal axis by a gripping member acting upon a top neck of the container to retain the container in a suspended position.

* * * * *